US011184962B2

(12) United States Patent
Yang et al.

(10) Patent No.: US 11,184,962 B2
(45) Date of Patent: Nov. 23, 2021

(54) BREATHING LIGHT ADJUSTING METHOD, APPARATUS AND ELECTRONIC DEVICE

(71) Applicant: SHENZHEN GOODIX TECHNOLOGY CO., LTD., Shenzhen (CN)

(72) Inventors: Ziwei Yang, Shenzhen (CN); Yaohe Li, Shenzhen (CN); Bo Tan, Shenzhen (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 228 days.

(21) Appl. No.: 16/454,020

(22) Filed: Jun. 26, 2019

(65) Prior Publication Data

US 2019/0320510 A1 Oct. 17, 2019

Related U.S. Application Data

(63) Continuation of application No. PCT/CN2018/078293, filed on Mar. 7, 2018.

(51) Int. Cl.
*H05B 47/10* (2020.01)
*H05B 47/14* (2020.01)
(Continued)

(52) U.S. Cl.
CPC ..... *H05B 45/10* (2020.01); *H05B 45/325* (2020.01); *H05B 47/14* (2020.01); *F21V 23/003* (2013.01); *F21Y 2115/10* (2016.08)

(58) Field of Classification Search
None
See application file for complete search history.

(56) References Cited

U.S. PATENT DOCUMENTS 8,074,085 B2 12/2011 Lehmann
9,345,103 B1 5/2016 Letourneur
9,769,898 B1 * 9/2017 Buthker ..... H05B 45/10

FOREIGN PATENT DOCUMENTS

CN 102438367 A 5/2012
CN 103974499 A 8/2014
(Continued)

OTHER PUBLICATIONS

The first Office Action of the parallel EP application.
(Continued)

*Primary Examiner* — Dedei K Hammond
(74) *Attorney, Agent, or Firm* — J.C. Patents

(57) ABSTRACT

The present disclosure provides a breathing light adjustment method, an apparatus and an electronic device, a relation curve representing relationship between a visual brightness and an electrical signal of a breathing light is determined; the visual brightness interval is equally divided according to a brightness level limit, and an electrical signal value corresponding to each brightness level after the equally dividing is determined; a ratio between the electrical signal value corresponding to each brightness level and a maximum electrical signal value is determined; and a magnitude of the electrical signal value inputted into the breathing light is adjusted according to the ratio between the electrical signal value corresponding to each brightness level and the maximum electrical signal value, so that the brightness of the breathing light presents an effect of linear gradual change which suits human vision.

18 Claims, 6 Drawing Sheets

(51) Int. Cl.

| | |
|---|---|
| ***H05B 45/10*** | (2020.01) |
| ***H05B 45/325*** | (2020.01) |
| *F21Y 115/10* | (2016.01) |
| *F21V 23/00* | (2015.01) |

(56) References Cited

FOREIGN PATENT DOCUMENTS

| | | | |
|---|---|---|---|
| CN | 105118446 | A | 12/2015 |
| CN | 204968191 | U | 1/2016 |
| CN | 106817466 | A | 6/2017 |
| CN | 107172774 | A | 9/2017 |
| CN | 107249146 | A | 10/2017 |
| WO | 2017/190986 | A1 | 11/2017 |

OTHER PUBLICATIONS

The Chinese International Search Report of corresponding international application No. PCT/CN2018/078293, dated Nov. 27, 2018.
The extended European Search Report of corresponding European application No. 18893337.8-1202, dated Jan. 24, 2020.
First Office Action for prior CN application No. 201880000362.7.

* cited by examiner

BREATHING LIGHT ADJUSTING METHOD, APPARATUS AND ELECTRONIC DEVICE

CROSS-REFERENCE TO RELATED APPLICATIONS

The present application is a continuation of International Application No. PCT/CN2018/078293, filed on Mar. 7, 2018, which is hereby incorporated by reference in its entirety.

TECHNICAL FIELD

The present disclosure relates to brightness adjustment technologies, in particular, to a breathing light adjusting method, an apparatus and an electronic device.

BACKGROUND

A breathing light is a kind of signal light with even change of brightness, which can simulate the breathing effect of human being. Breathing lights are widely used in electronic products to serve as notifications and reminders.

At present, a common method for implementing the breathing light is to generate a square wave with an evenly changing duty cycle as a driving control signal to drive an LED in the breathing light to emit light, by controlling a Pulse Width Modulation (PWM) module. However, in practical use, the evenly changing PWM duty cycle cannot result in an expected breathing effect, because brightness of the LED is not strictly proportional to a current intensity, that is to say, the brightness of the LED does not strictly increase in proportion to an increase of the current intensity, and the brightness of the LED does not strictly decrease in proportion to a decrease of the current intensity; at the same time, there is a nonlinear relationship between brightness perceived by a human's eyes and actual brightness of the LED. Therefore, when the PWM duty cycle of the driving control signal changes evenly, the brightness perceived by the human's eyes changes nonlinearly, which makes the effect of the evenly gradual change of the brightness of the breathing light undesirable.

SUMMARY

The present disclosure provides a breathing light adjustment method, an apparatus and an electronic device, which are used to solve the technical problem of the prior art that the effect of even gradual change of a breathing light brightness is not desirable.

An aspect of the present disclosure provides a breathing light adjustment method, including:

determining a relation curve representing relationship between visual brightness and an electrical signal of a breathing light;

equally dividing a visual brightness interval according to a brightness level limit, and determining an electrical signal value corresponding to each brightness level after the equally dividing;

determining a ratio between the electrical signal value corresponding to each brightness level and a maximum electrical signal value; and adjusting, according to the ratio between the electrical signal value corresponding to each brightness level and the maximum electrical signal value, a magnitude of an electrical signal value inputted into the breathing light.

Optionally, the determining a relation curve representing relationship between visual brightness and an electrical signal of a breathing light includes:

determining a relation curve representing relationship between actual amount of luminescence and the electrical signal of the breathing light;

determining a relation curve representing relationship between the visual brightness and the actual amount of luminescence of the breathing light; and determining the relation curve representing relationship between the visual brightness and the electrical signal according to the relation curve representing relationship between the actual amount of luminescence and the electrical signal of the breathing light and the relation curve representing relationship between the visual brightness and the actual amount of luminescence of the breathing light.

Optionally, the adjusting, according to the ratio between the electrical signal value corresponding to each brightness level and the maximum electrical signal value, a magnitude of an electrical signal value inputted into the breathing light includes:

generating a pulse width modulation (PWM) duty cycle control signal corresponding to each brightness level according to the ratio between the electrical signal value corresponding to each brightness level, the maximum electrical signal value and a period of a PWM signal; and inputting the PWM duty cycle control signal corresponding to each brightness level into the breathing light sequentially, such that the breathing light presents a sequential change in brightness according to the brightness level.

Optionally, the method further includes:

determining a first hold time of each brightness level according to a breathing cycle of the breathing light.

Optionally, the determining a first hold time of each brightness level according to a breathing cycle of the breathing light includes:

equally dividing the breathing cycle of the breathing light according to the brightness level limit to obtain the first hold time of each brightness level.

Optionally, the method further includes:

a change trend of the brightness level within each breathing cycle includes:

sequentially changing from light to dark, or sequentially changing from dark to light;

a change trend of brightness between two adjacent breathing cycles includes at least one of the following changes:

sequentially changing from dark to light, and then sequentially changing from light to dark;

sequentially changing from light to dark, and then sequentially changing from dark to light;

sequentially changing from light to dark, and then sequentially changing from light to dark;

sequentially changing from dark to light, and then sequentially changing from dark to light.

Optionally, the method further includes:

determining, according to a second hold time, a time for maintaining a preset state between two adjacent breathing cycles; where the preset state is a state the breathing light is completely off, or a state the breathing light is maintained at any of the brightness level.

Another aspect of the present disclosure provides a breathing light adjusting apparatus, including:

a storage module, configured to store ratio data, where the ratio data is ratio data between an electrical signal value corresponding to each brightness level and a maximum electrical signal value, where the electrical signal value corresponding to each brightness level is obtained by equally dividing a visual brightness interval according to a brightness level limit based on a relation curve representing relationship between visual brightness and an electric signal of a breathing light, and determining the electrical signal value corresponding to each brightness level after the equally dividing; and a digital controller, configured to read the ratio data from the storage module, and adjust, according to the ratio data between the electrical signal value corresponding to each brightness level and the maximum electrical signal value, a magnitude of the electrical signal value inputted into the breathing light.

Optionally, the relation curve representing relationship between the visual brightness and the electrical signal of the breathing light is determined as follows: determining a relation curve representing relationship between actual amount of luminescence and the electrical signal of the breathing light; determining a relation curve representing relationship between visual brightness and the actual amount of luminescence of the breathing light; and determining the relation curve representing relationship between the visual brightness and the electrical signal of the breathing light according to a relation curve representing relationship between the actual amount of luminescence and the electrical signal of the breathing light and a relation curve representing relationship between the visual brightness and the actual amount of luminescence of the breathing light.

Optionally, further including: a configuration register; where the configuration register stores a period of a Pulse Width Modulation (PWM) signal; the storage module is a read only memory (ROM), and the ROM stores the ratio data between the electrical signal value corresponding to each brightness level and the maximum electrical signal value; the digital controller includes: a duty cycle calculating module, configured to read the ratio data between the electrical signal value corresponding to each brightness level and the maximum electrical signal value from the ROM, read the period of the PWM signal from the configuration register, and generate a PWM duty cycle control signal corresponding to each brightness level according to the ratio data between the electrical signal value corresponding to each brightness level, the maximum electrical signal value and the period of the PWM signal;

further including: a PWM generating module, configured to receive the PWM duty cycle control signal corresponding to each brightness level, and sequentially input the PWM duty cycle control signal corresponding to each brightness level into the breathing light, such that the breathing light presents a sequential change in brightness according to the brightness level.

Optionally, the configuration register further stores a breathing cycle of the breathing light, and the digital controller further includes a brightness level controlling module;

where the brightness level controlling module is configured to read the breathing cycle from the configuration register and determine a hold time of each brightness level according to the breathing cycle of the breathing light.

Optionally, the brightness level controlling module is specifically configured to equally divide the breathing cycle of the breathing light according to the brightness level limit to obtain a first hold time of each brightness level.

Optionally, further including: a first counter;

where the first counter is configured to count a clock cycle of the breathing light adjusting apparatus to obtain a value of the number of the clock cycle, and the first counter is further configured to read the period of the PWM signal from the configuration register, compare the value of the number of the clock cycle with the period of the PWM signal, and clear the value of the number of the clock cycle at the end of each period of the PWM signal.

Optionally, the PWM generating module is specifically configured to receive the PWM duty cycle control signal corresponding to each brightness level, read the value of the number of the clock cycle counted by the first counter, compare the value of the number of the clock cycle with the PWM duty cycle control signal corresponding to each brightness level, determine whether each clock pulse signal in the PWM duty cycle control signal is set to 0 or 1, generate a clock pulse sequence of the PWM duty cycle control signal corresponding to each brightness level, and sequentially input the clock pulse sequence of the PWM duty cycle control signal corresponding to each brightness level into the breathing light, such that the breathing light presents a sequential change in brightness according to the brightness level.

Optionally, further including: a second counter;

where the second counter is configured to count a clock cycle of the breathing light adjusting apparatus to obtain a value of the number of the clock cycle, and the second counter is further configured to read the hold time of each brightness level from the brightness level controlling module, compare the value of the number of the clock cycle with the hold time of each brightness level, and clear the value of the number of the clock cycle at the end of the hold time of each brightness level.

Optionally, the brightness level controlling module is further configured to progressively increase or decrease a current brightness level to an identifier corresponding to a next brightness level each time when the second counter clears the value of the number of the clock cycle, and send the identifier corresponding to the next brightness level to the ROM;

the ROM is configured to update an addressing signal according to the identifier corresponding to the next brightness level, and read ratio data between an electrical signal value corresponding to the next brightness level indicated by the identifier and the maximum electrical signal value.

Optionally, the PWM generating module is further configured to determine, according to a second hold time, a time for maintaining a preset state between two adjacent breathing cycles; where the preset state is a state the breathing light is completely off, or a state the breathing light is maintained at any of the brightness level.

Optionally, the PWM generating module is specifically configured to read the current brightness level of the brightness level controlling module, and initiate timing the second hold time when the current brightness level is a last brightness level of the breathing cycle.

Optionally, the configuration register further stores a change trend of the brightness level within each breathing cycle, and the change trend of the brightness level within each breathing cycle includes: sequentially changing from light to dark, or sequentially changing from dark to light;

the configuration register further stores a change trend of brightness between two adjacent breathing cycles, and the brightness change trend between the two adjacent breathing cycles includes at least one of the following changes:

sequentially changing from dark to light, and then sequentially changing from light to dark;

sequentially changing from light to dark, and then sequentially changing from dark to light;

sequentially changing from light to dark, and then sequentially changing from light to dark;

sequentially changing from dark to light and then sequentially changing from dark to light.

Yet another aspect of the present disclosure provides an electronic device, including a program that enables the electronic device to perform the method according to any one of the methods described above when executed on the electronic device.

As can be seen from the above aspects, in the breathing light adjustment method, apparatus and electronic device of the present disclosure, the relation curve representing relationship between the visual brightness and the electrical signal of the breathing light is determined; the visual brightness interval is equally divided according to the brightness level limit, and the electrical signal value corresponding to each brightness level after the equally dividing is determined; the ratio between the electrical signal value corresponding to each brightness level and the maximum electrical signal value is determined; and the magnitude of the electrical signal value inputted into the breathing light is adjusted according to the ratio between the electrical signal value corresponding to each brightness level and the maximum electrical signal value, so that the brightness of the breathing light presents an effect of linear gradual change which suits human vision.

BRIEF DESCRIPTION OF THE DRAWINGS

In order to more clearly illustrate technical solutions in embodiments of the present disclosure or in the prior art, accompanying drawings required for describing the embodiments or the prior art will be briefly described below. Apparently, the accompanying drawings in the following description are some of the embodiments of the present disclosure, and other drawings can be obtained by those skilled in the art based on these accompanying drawings without any creative effort.

DESCRIPTION OF EMBODIMENTS

Technical solutions in embodiments of the present disclosure will be clearly and completely described below in conjunction with the accompanying drawings in the embodiments of the present disclosure, in order to make the objects, technical solutions and advantages of the embodiments of the present disclosure clearer. Apparently, the described embodiments are a part of, instead of all of the embodiments of the present disclosure. All other embodiments obtained by those skilled in the art based on the embodiments of the present disclosure without creative labor will fall within the scope of the present disclosure.

Figure 1A:
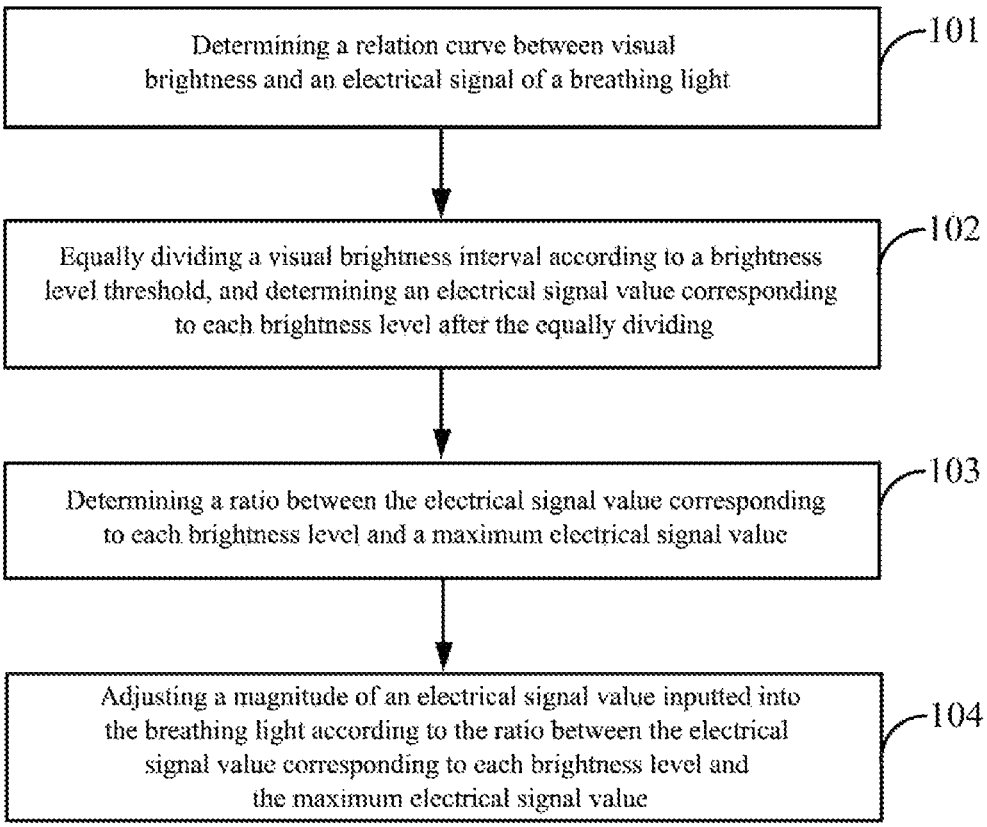
FIG. 1*a* is a flowchart of a breathing light adjusting method according to an exemplary embodiment of the present disclosure.

FIG. 1*a* is a flowchart of a breathing light adjusting method according to an exemplary embodiment of the present disclosure. As shown in FIG. 1*a*, the executive entity of the breathing light adjusting method in this embodiment may be an electronic device provided with a breathing light, for example, a mobile or non-mobile electronic device such as a desktop, a laptop, a portable android device (PDA) or a mobile phone, and such electronic devices may be collectively referred to as "terminals". A software program is provided in the terminal to execute the breathing light adjusting method, or a logic circuit composed of various electronic components is provided in the terminal, and the breathing light adjusting method of this embodiment is implemented by the logic circuit. The breathing light adjusting method of this embodiment can specifically include:

Step 101, determining a relation curve representing relationship between visual brightness and an electrical signal of a breathing light.

Figure 1B:
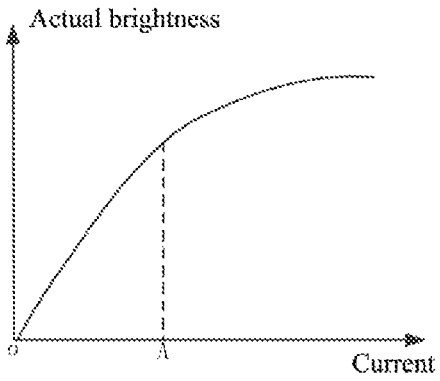
FIG. 1*b* is a graph of a relation curve representing relationship between actual brightness and a current according to the embodiment illustrated in FIG. 1*a;*

In this step, the electrical signal driving the breathing light to emit light may be a current signal or a voltage signal, and in the following, the electrical signal being a current signal is taken as an example for illustration. As shown in FIG. 1*b*, the brightness of the breathing light increases with the increase of the driving current, and the breathing light brightness is approximately proportional to the driving current within a certain range (e.g. the range from Point o to Point A) of the driving current; the slope of the characteristic curve of the brightness the breathing light becomes smaller due to the increase of a temperature of the device when the current is outside of that range (extended from Point A to the range where the current increases). That is to say, the brightness of the breathing light does not strictly increase in proportion to the increase of the current intensity, and the brightness of the breathing light presents a nonlinear change with the change of the current.

Figure 1C:
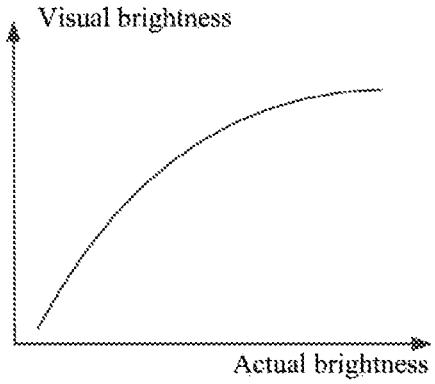
FIG. 1*c* is a graph of a relation curve representing relationship between actual brightness and visual brightness according to the embodiment illustrated in FIG. 1*a;*
Figure 1D:
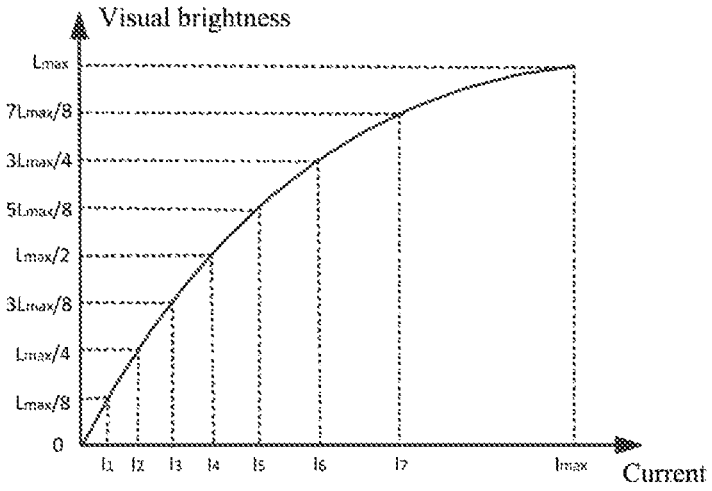
FIG. 1*d* is a graph of a relation curve representing relationship between visual brightness and a current according to the embodiment illustrated in FIG. 1*a;*

At the same time, according to the Weber-Fechner Law, the brightness perceived by a human's eyes is logarithmic to the actual brightness, as shown in FIG. 1*c*. Therefore, according to FIG. 1*b* and FIG. 1*c*, a relation curve representing relationship between the current and the visual brightness perceived by a human's eyes can be obtained (as shown in FIG. 1*d*). FIG. 1*d* is a relation curve representing relationship between the visual brightness and the electrical signal of the breathing light.

Step 102, equally dividing a visual brightness interval according to a brightness level limit, and determining an electrical signal value corresponding to each brightness level after the equally dividing.

In this step, the brightness level limit may be set by the user via the electronic device (in which a breathing light is integrated) thus to set the brightness level of the breathing light. The greater the brightness level limit is, the more brightness levels of the brightness gradual change the breathing light presents, and the more desirable the effect of gradual change is; the smaller the brightness level limit is, the less brightness levels of the brightness gradual change the breathing light presents, and if there are too few brightness levels, the change of the brightness of the breathing light will be unsmooth in the view of a person. Therefore, preferably, the brightness level limit may be set to 128 levels of brightness, and for the purpose of simplicity for illustration, FIG. 1*d* shows the effect when the brightness level limit is 8 levels. The visual brightness is divided into levels according to the maximum visual brightness perceived by a human's eyes corresponding to the magnitude of the current of a constant current source. In order to present a linear change in brightness, a visual brightness interval is equally divided, and a driving current value corresponding to each brightness level is obtained according to the relation curve of FIG. 1*d*. The driving current value is not distributed as being divided equally, but a brightness that changes level-by-level can be obtained through the gradual change of the driving current values.

Step 103, determining a ratio between the electrical signal value corresponding to each brightness level and a maximum electrical signal value.

In this step, the ratios between the electrical signal value corresponding to each brightness level, for example $I_1$, $I_2 \ldots I_{max}$ in FIG. 1*d*, and $I_{max}$ is calculated, so that current ratio values corresponding to respective brightness levels, $I_1/I_{max}$, $I_2/I_{max} \ldots 1$, are obtained.

Step 104, adjusting a magnitude of an electrical signal value inputted into the breathing light according to the ratio between the electrical signal value corresponding to each brightness level and the maximum electrical signal value.

In this step, the magnitude of the current value inputted into the breathing light is adjusted according to the ratio values of $I_1/I_{max}$, $I_2/I_{max} \ldots 1$ corresponding to respective brightness levels obtained in Step 103. For example, currents of $I_1$, $I_2 \ldots$ and $I_{max}$ are inputted into the breathing light, so that the breathing light presents an effect of gradual change from the first level of brightness to the eighth level of brightness; or currents of $I_{max}$, $I_7$, $I_6 \ldots$ and $I_1$ may be inputted into the breathing light, so that the breathing light presents an effect of gradual change from the eighth level of brightness to the first level of brightness.

In the breathing light adjusting method of this embodiment, the relation curve representing relationship between the visual brightness and the electrical signal of the breathing light is determined; the visual brightness interval is equally divided according to the brightness level limit, and the electrical signal value corresponding to each brightness level after the equally dividing is determined; the ratio between the electrical signal value corresponding to each brightness level and the maximum electrical signal value is determined; and the magnitude of the electrical signal value inputted into the breathing light is adjusted according to the ratio between the electrical signal value corresponding to each brightness level and the maximum electrical signal value, so that the brightness of the breathing light presents an effect of linear gradual change which suits human vision.

Figure 2:
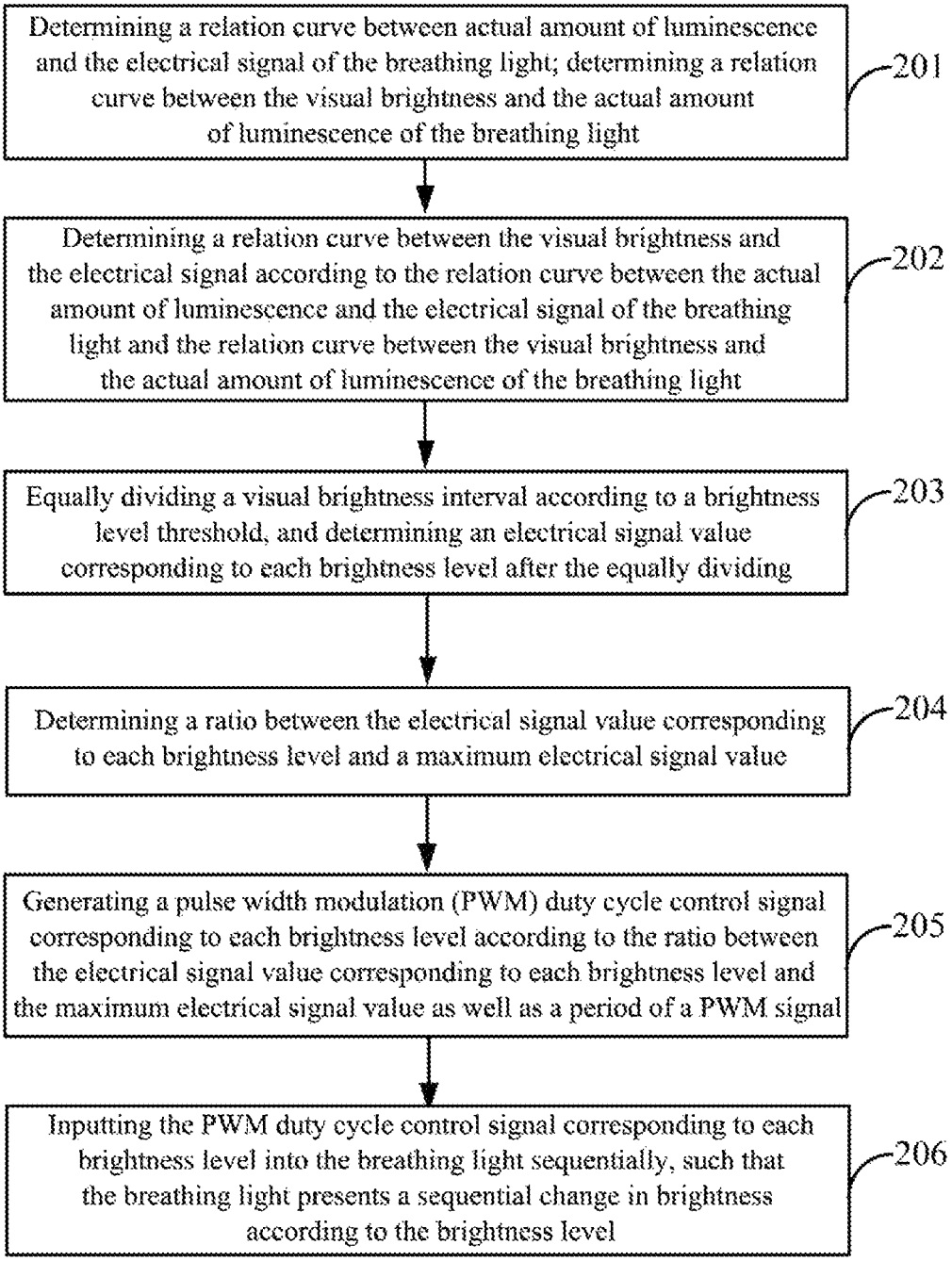
FIG. 2 is a flowchart of a breathing light adjusting method according to another exemplary embodiment of the present disclosure.

FIG. 2 is a flowchart of a breathing light adjusting method according to another exemplary embodiment of the present disclosure. As shown in FIG. 2, based on the previous embodiment, the breathing light adjusting method of this embodiment specifically includes:

Step 201, determining a relation curve representing relationship between actual amount of luminescence and the electrical signal of the breathing light; determining a relation curve representing relationship between the visual brightness and the actual amount of luminescence of the breathing light.

In this step, the relation curve representing relationship between the actual amount of luminescence and the electrical signal of the breathing light is shown in FIG. 1*b* of the previous embodiment, and the relation curve representing relationship between the visual brightness and the actual amount of luminescence of the breathing light is shown in FIG. 1*c* of the previous embodiment. The above relation curves may be obtained by collecting a certain number of input current values of the breathing light and measuring brightness values corresponding to the respective collected current values, so that the above curves of FIG. 1*b* and FIG. 1*c* are obtained by fitting.

Step 202, determining a relation curve representing relationship between the visual brightness and the electrical signal according to the relation curve representing relationship between the actual amount of luminescence and the electrical signal of the breathing light and the relation curve representing relationship between the visual brightness and the actual amount of luminescence of the breathing light.

Step 203, equally dividing a visual brightness interval according to a brightness level limit, and determining an electrical signal value corresponding to each brightness level after the equally dividing.

Step 204, determining a ratio between the electrical signal value corresponding to each brightness level and a maximum electrical signal value.

Step 205, generating a pulse width modulation (PWM) duty cycle control signal corresponding to each brightness level according to the ratio between the electrical signal value corresponding to each brightness level, the maximum electrical signal value and a period of a PWM signal.

In this step, the Pulse Width Modulation is a technique of controlling an analog circuit by using a digital output of a microprocessor, in which PWM duty cycle control signals representing different current intensities are obtained by modulating the duty cycle of each PWM signal (a PWM signal period). Therefore, with the PWM signals with different duty cycles bearing different current intensities, the effect of the brightness of the breathing light gradually changing with the current intensity is achieved by sequentially inputting the PWM duty cycle control signal corresponding to each brightness level into the breathing light.

Step 206, inputting the PWM duty cycle control signal corresponding to each brightness level into the breathing light sequentially, such that the breathing light presents a sequential change in brightness according to the brightness level.

In this step, in order to control a gradual change time of the breathing light, a first hold time of each brightness level may be determined according to a breathing cycle of the breathing light. Where the breathing cycle is a time interval between a display start time of the lowest brightness level and the display end time of the highest brightness level; or the breathing cycle is a time interval between the display start time of the highest brightness level and the display end time of the lowest brightness level.

Optionally, in order to make the effect of the gradual change of the breathing light more even, that is to say, to make the breathing light stay at each brightness level for an equal period of time, the breathing cycle of the breathing light may be equally divided according to the brightness level limit to obtain the first hold time of each brightness level.

Optionally, in order to make the effect of the gradual change of the breathing light more diverse, the user may set a change trend of the brightness of the breathing light by himself/herself, where the change trend of the brightness level within each breathing cycle includes: sequentially changing from light to dark, or sequentially changing from dark to light; a change trend of the brightness between two adjacent breathing cycles includes at least one of the following changes: sequentially changing from dark to light, and then sequentially changing from light to dark; sequentially changing from light to dark, and then sequentially changing from dark to light; sequentially changing from light to dark, and then sequentially changing from light to dark; sequentially changing from dark to light, and then sequentially changing from dark to light.

Optionally, a second hold time may be set between every two breathing cycles, which is a time interval between adjacent breathing cycles. According to the second hold time, a hold time of a preset state between two adjacent breathing cycles is determined; where the preset state is a state in which the breathing light is completely off or a state in which the breathing light is maintained at any brightness level. That is to say, after the end of one breathing cycle, the breathing light stays completely off or in any preset brightness level for a certain time (the second hold time) and then enters the process of gradual change of the brightness in the next breathing cycle, where the second hold time and the preset state may be set by the user himself/herself.

Figure 3:
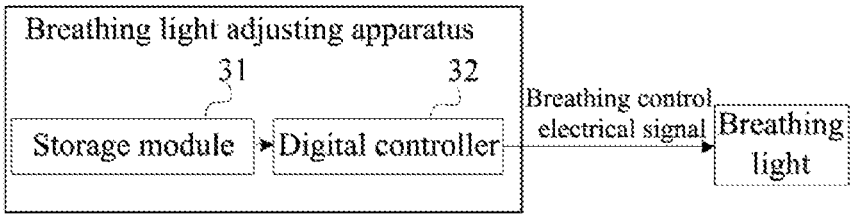
FIG. 3 is a schematic structural diagram of a breathing light adjusting apparatus according to an exemplary embodiment of the present disclosure.

FIG. 3 is a schematic structural diagram of a breathing light adjusting apparatus according to an exemplary embodiment of the present disclosure. As shown in FIG. 3, the breathing light adjusting apparatus may be implemented by using a logic circuit, where the logic circuit includes the following logic modules:

a storage module 31, configured to store ratio data, where the ratio data is ratio data between an electrical signal value corresponding to each brightness level and a maximum electrical signal value, where the electrical signal value corresponding to each brightness level is obtained by equally dividing a visual brightness interval according to a brightness level limit based on a relation curve representing relationship between visual brightness and an electric signal of a breathing light, and determining the electrical signal value corresponding to each brightness level after the equally dividing; a digital controller 32, configured to read the ratio data from the storage module 31 and adjust a magnitude of the electrical signal value inputted into the breathing light according to the ratio data between the electrical signal value corresponding to each brightness level and the maximum electrical signal value.

Where the ratio data stored in the storage module 31 may be calculated by a processor integrated in the breathing light adjusting apparatus, and then the ratio data is stored in the storage module 31; or the ratio data may be calculated by an external electronic device independent of the breathing light adjusting apparatus, and the calculated ratio data may be transmitted to the breathing light adjusting apparatus by the external electronic device, and stored in the storage module 31.

The breathing light adjusting apparatus of this embodiment may be used to perform the steps of the previous method embodiments. The implement principles thereof are similar, and will not be repeated herein.

The breathing light adjusting apparatus of this embodiment includes a storage module which is configured to store ratio data; where the ratio data is the ratio data between the electrical signal value corresponding to each brightness level and the maximum electrical signal value, where the electrical signal value corresponding to each brightness level is obtained by equally dividing the visual brightness interval according to the brightness level limit based on the relation curve representing relationship between visual brightness and the electric signal of the breathing light, and determining the electrical signal value corresponding to each brightness level after the equally dividing; the breathing light adjusting apparatus of this embodiment further includes a digital controller, which is configured to read the ratio data from the storage module and adjust the magnitude of the electrical signal value inputted into the breathing light according to the ratio data between the electrical signal value corresponding to each brightness level and the maximum electrical signal value, so that the brightness of the breathing light presents an effect of linear gradual change which suits human vision.

Figure 4:
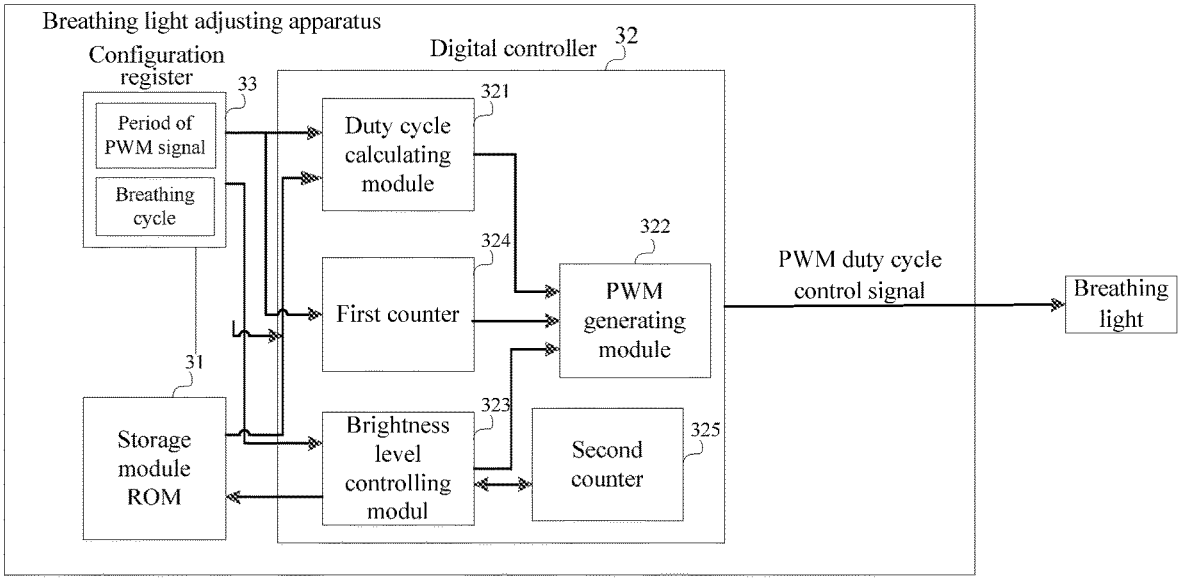
FIG. 4 is a schematic structural diagram of a breathing light adjusting apparatus according to another exemplary embodiment of the present disclosure.

FIG. 4 is a schematic structural diagram of a breathing light adjusting apparatus according to another exemplary embodiment of the present disclosure. As shown in FIG. 4, on the basis of the above embodiment, the relation curve representing relationship between the visual brightness and the electrical signal of the breathing light is based on a relation curve representing relationship between actual amount of luminescence and the electrical signal of the breathing light; a relation curve representing relationship between the visual brightness and the actual amount of luminescence of the breathing light is determined; and the relation curve representing relationship between the visual brightness and the electrical signal of the breathing light is determined according to the relation curve representing relationship between the actual amount of luminescence and the electrical signal of the breathing light and the relation curve representing relationship between the visual brightness and the actual amount of luminescence of the breathing light.

Optionally, the storage module 31 may be a read only memory (ROM) in which the ratio data between the electrical signal value corresponding to each brightness level and the maximum electrical signal value is stored. Specifically, a relative current ratio of each level may be digitally encoded, for example, a 10-bit code is used to represent the relative current ratio of each level, and then each code is stored in the ROM.

Optionally, the breathing light adjusting apparatus further includes a configuration register 33, which stores a period of a Pulse Width Modulated (PWM) signal and may also store a breathing cycle of the breathing light.

The digital controller 32 includes: a duty cycle calculating module 321, configured to read the ratio data between the electrical signal value corresponding to each brightness level and the maximum electrical signal value from the ROM, read the period of the PWM signal from the configuration register 33, and generate a PWM duty cycle control signal corresponding to each brightness level according to the ratio data between the electrical signal value corresponding to each brightness level, the maximum electrical signal value and the period of the PWM signal.

Specifically, the duty cycle calculating module 321 multiplies the period value of the PWM signal read from the configuration register 33 by the 10-bit code corresponding to the current brightness level read from the ROM, and then extracts high bits of data according to a preset number of reserved bits to obtain the number of clock cycles in which a PWM output waveform is kept at high level (1). Where the number of clock cycles may be determined by counting through a first counter 324.

Optionally, the digital controller 32 further includes: the first counter 324, configured to count the clock cycle of the breathing light adjusting apparatus to obtain a value of the number of the clock cycle; and the first counter 324 is further configured to read the period of the PWM signal from the configuration register 33, compare the value of the number of the clock cycle with the period of the PWM signal, and clear the value of the number of the clock cycle at the end of each PWM signal period.

Optionally, the digital controller 32 further includes a brightness level controlling module 323. The brightness level controlling module 323 reads the breathing cycle from the configuration register 33 and determines a hold time of each brightness level according to the breathing cycle.

In order to enable the breathing light to present an effect of even change in time of gradually changing brightness, a presentation time of brightness of each brightness level may be set to be the same. Specifically, the brightness level controlling module 323 is configured to equally divide the breathing cycle of the breathing light according to the brightness level limit to obtain a first hold time of each brightness level.

Optionally, the digital controller 32 further includes: a PWM generating module 322, configured to receive the PWM duty cycle control signal corresponding to each brightness level, input the PWM duty cycle control signal corresponding to each brightness level into the breathing light sequentially so as to enable the breathing light to present a sequential change in brightness according to the brightness level.

Specifically, the PWM generating module 322 is configured to receive the PWM duty cycle control signal corresponding to each brightness level outputted by the duty cycle calculating module 321, read the value of the number of the clock cycle from the first counter 324, compare the value of the number of the clock cycle with the PWM duty cycle control signal corresponding to each brightness level, determine whether each clock pulse signal in the PWM duty cycle control signal is set to 0 (low level) or 1 (high level), generate a clock pulse sequence of the PWM duty cycle control signal corresponding to each brightness level, then input the clock pulse sequence of the PWM duty cycle control signal corresponding to each brightness level into the breathing light sequentially, so as to enable the breathing light to present a sequential change in brightness according to the brightness level.

In addition, in order to implement an effect of level-by-level change in various brightness levels, the clock cycle of the breathing light adjusting apparatus is counted by a second counter 325 in the digital controller 32, to obtain the value of the number of the clock cycle; the second counter 325 is further configured to read the hold time of each brightness level from the brightness level controlling module 323, compare the value of the number of the clock cycle with the hold time of each brightness level, and clear the value of the number of the clock cycle at the end of the hold time of each brightness level.

Correspondingly, the brightness level controlling module 323 is further configured to progressively increase or decrease the current brightness level to an identifier corresponding to the next brightness level each time when the second counter clears the value of the number of the clock cycle (for example, increase or decrease the brightness level by 1 at the end of counting of each level), and send the identifier corresponding to the next brightness level to the ROM 33. The ROM 33 updates an addressing signal according to the identifier corresponding to the next brightness level, reads ratio data between an electrical signal value corresponding to the next brightness level and the maximum electrical signal value, so that the duty cycle calculating module 321 reads the data of each brightness level in the ROM to implement change among respective brightness levels.

Optionally, the PWM generating module 322 is further configured to determine a time for maintaining a preset state between two adjacent breathing cycles according to a second hold time, where the preset state is a state in which the breathing light is completely off, or a state in which the breathing light is maintained at any brightness level. As mentioned above, the second hold time and the preset state may be set by the user himself/herself. Where timing the second hold time is initiated when the PWM generating module 322 has read that the current brightness level of the brightness level controlling module 323 is the last brightness level of the breathing cycle.

Optionally, the configuration register 33 further stores a change trend of the brightness level within each breathing cycle, where the change trend includes: sequentially changing from light to dark, or sequentially changing from dark to light. The configuration register 33 further stores the brightness change trend between two adjacent breathing cycles, and the change trend includes at least one of the following changes:

sequentially changing from dark to light, and then sequentially changing from light to dark;

sequentially changing from light to dark, and then sequentially changing from dark to light;

sequentially changing from light to dark, and then sequentially changing from light to dark;

sequentially changing from dark to light, and then sequentially changing from dark to light.

As mentioned above, the change trend may be set by the user himself/herself, so as to implement a more diverse effect of gradual change of the breathing light.

The present disclosure also provides an electronic device including a program that enables the electronic device to perform the method of any of the previous embodiments when executed on the electronic device.

It should be noted that the above embodiments are only used to illustrate the technical solutions of the present disclosure, and the technical solutions of the present disclosure are not limited thereto. Although the present disclosure has been described in detail with reference to the foregoing embodiments, those skilled in the art should understand that the technical solutions described in the above embodiments may be modified, or some of the technical features may be equivalently substituted, and those modifications or substitutions do not deviate the nature of the corresponding technical solutions from the scope of the technical solutions of respective embodiments of the present disclosure.

What is claimed is:

1. A breathing light adjusting method, comprising:

determining a relation curve representing relationship between visual brightness and an electrical signal of a breathing light;

equally dividing a visual brightness interval to obtain a plurality of brightness levels according to a brightness level limit, and determining an electrical signal value corresponding to each brightness level;

determining a ratio between the electrical signal value corresponding to each brightness level and a maximum electrical signal value; and adjusting, according to the ratio between the electrical signal value corresponding to each brightness level and the maximum electrical signal value, a magnitude of an electrical signal value inputted into the breathing light;

wherein the method further comprises:

determining a first hold time of each brightness level according to a breathing cycle of the breathing light.

2. The method according to claim 1, wherein the determining a relation curve representing relationship between visual brightness and an electrical signal of a breathing light comprises:

determining a relation curve representing relationship between actual amount of luminescence and the electrical signal of the breathing light;

determining a relation curve representing relationship between the visual brightness and the actual amount of luminescence of the breathing light; and determining the relation curve representing relationship between the visual brightness and the electrical signal, according to the relation curve representing relationship between the actual amount of luminescence and the electrical signal of the breathing light and, the relation curve representing relationship between the visual brightness and the actual amount of luminescence of the breathing light.

3. The method according to claim 1, wherein the adjusting, according to the ratio between the electrical signal value corresponding to each brightness level and the maximum electrical signal value, a magnitude of an electrical signal value inputted into the breathing light comprises:

generating a pulse width modulation (PWM) duty cycle control signal corresponding to each brightness level, according to the ratio between the electrical signal value corresponding to each brightness level, the maximum electrical signal value and a period of a PWM signal; and inputting the PWM duty cycle control signal corresponding to each brightness level into the breathing light sequentially, such that the breathing light presents a sequential change in brightness according to the brightness level.

4. The method according to claim 1, wherein the determining a first hold time of each brightness level according to a breathing cycle of the breathing light comprises:

equally dividing the breathing cycle of the breathing light according to the brightness level limit to obtain the first hold time of each brightness level.

5. The method according to claim 1, wherein:

a change trend of the brightness level within each breathing cycle comprises:

sequentially changing from light to dark, or sequentially changing from dark to light;

a change trend of brightness between two adjacent breathing cycles comprises at least one of the following changes:

sequentially changing from dark to light, and then sequentially changing from light to dark;

sequentially changing from light to dark, and then sequentially changing from dark to light;

sequentially changing from light to dark, and then sequentially changing from light to dark;

sequentially changing from dark to light, and then sequentially changing from dark to light.

6. The method according to claim 1, wherein the method further comprises:

determining, according to a second hold time, a time for maintaining a preset state between two adjacent breathing cycles; wherein the preset state is a state the breathing light is completely off, or a state the breathing light is maintained at any of the brightness level.

7. A breathing light adjusting apparatus, comprising:

a storage module, configured to store ratio data, wherein the ratio data is ratio data between an electrical signal value corresponding to each brightness level and a maximum electrical signal value, wherein the electrical signal value corresponding to each brightness level is obtained by equally dividing a visual brightness interval to obtain a plurality of brightness levels according to a brightness level limit based on a relation curve representing relationship between visual brightness and an electric signal of a breathing light, and determining the electrical signal value corresponding to each brightness level; and a digital controller, configured to read the ratio data from the storage module, and adjust, according to the ratio data between the electrical signal value corresponding to each brightness level and the maximum electrical signal value, a magnitude of the electrical signal value inputted into the breathing light;

wherein the configuration register further stores a breathing cycle of the breathing light, and the digital controller further comprises a brightness level controlling module;

wherein the brightness level controlling module is configured to read the breathing cycle from the configuration register and determine a hold time of each brightness level according to the breathing cycle of the breathing light.

8. The apparatus according to claim 7, wherein the relation curve representing relationship between the visual brightness and the electrical signal of the breathing light is determined by:

determining a relation curve representing relationship between actual amount of luminescence and the electrical signal of the breathing light;

determining a relation curve representing relationship between visual brightness and the actual amount of luminescence of the breathing light; and determining the relation curve representing relationship between the visual brightness and the electrical signal of the breathing light according to the relation curve representing relationship between the actual amount of luminescence and the electrical signal of the breathing light and the relation curve representing relationship between the visual brightness and the actual amount of luminescence of the breathing light.

9. The apparatus according to claim 7, further comprising: a configuration register; wherein the configuration register stores a period of a Pulse Width Modulation (PWM) signal; the storage module is a read only memory (ROM), and the ROM stores the ratio data between the electrical signal value corresponding to each brightness level and the maximum electrical signal value; the digital controller comprises: a duty cycle calculating module, configured to read the ratio data between the electrical signal value corresponding to each brightness level and the maximum electrical signal value from the ROM, read the period of the PWM signal from the configuration register, and generate a PWM duty cycle control signal corresponding to each brightness level according to the ratio data between the electrical signal value corresponding to each brightness level, the maximum electrical signal value and the period of the PWM signal;

further comprising: a PWM generating module, configured to receive the PWM duty cycle control signal corresponding to each brightness level, and sequentially input the PWM duty cycle control signal corresponding to each brightness level into the breathing light, such that the breathing light presents a sequential change in brightness according to the brightness level.

10. The apparatus according to claim 7, wherein, the brightness level controlling module is configured to equally divide the breathing cycle of the breathing light according to the brightness level limit to obtain a first hold time of each brightness level.

11. The apparatus according to claim 10, further comprising: a first counter;

wherein the first counter is configured to count a clock cycle of the breathing light adjusting apparatus to obtain a value of the number of the clock cycle, and the first counter is further configured to read the period of a PWM signal from the configuration register, compare the value of the number of the clock cycle with the period of the PWM signal, and clear the value of the number of the clock cycle at the end of each period of the PWM signal.

12. The apparatus according to claim 11, wherein, the PWM generating module is configured to receive the PWM duty cycle control signal corresponding to each brightness level, read the value of the number of the clock cycle counted by the first counter, compare the value of the number of the clock cycle with the PWM duty cycle control signal corresponding to each brightness level, determine whether each clock pulse signal in the PWM duty cycle control signal is set to 0 or 1, generate a clock pulse sequence of the PWM duty cycle control signal corresponding to each brightness level, and sequentially input the clock pulse sequence of the PWM duty cycle control signal corresponding to each brightness level into the breathing light, such that the breathing light presents a sequential change in brightness according to the brightness level.

13. The apparatus according to claim 10, further comprising: a second counter;

wherein the second counter is configured to count a clock cycle of the breathing light adjusting apparatus to obtain a value of the number of the clock cycle, and the second counter is further configured to read the hold time of each brightness level from the brightness level controlling module, compare the value of the number of the clock cycle with the hold time of each brightness level, and clear the value of the number of the clock cycle at the end of the hold time of each brightness level.

14. The apparatus according to claim 13, wherein, the brightness level controlling module is further configured to progressively increase or decrease a current brightness level to an identifier corresponding to a next brightness level each time when the second counter clears the value of the number of the clock cycle, and send the identifier corresponding to the next brightness level to a ROM;

the ROM is configured to update an addressing signal according to the identifier corresponding to the next brightness level, and read ratio data between an electrical signal value corresponding to the next brightness level indicated by the identifier and the maximum electrical signal value.

15. The apparatus according to claim 14, wherein, a PWM generating module is further configured to determine, according to a second hold time, a time for maintaining a preset state between two adjacent breathing cycles;

wherein the preset state is a state the breathing light is completely off, or a state the breathing light is maintained at any of the brightness level.

16. The apparatus according to claim 15, wherein, the PWM generating module is configured to read the current brightness level of the brightness level controlling module, and initiate timing the second hold time when the current brightness level is a last brightness level of the breathing cycle.

17. The apparatus according to claim 7, wherein, the configuration register further stores a change trend of the brightness level within each breathing cycle, and the change trend of the brightness level within each breathing cycle comprises: sequentially changing from light to dark, or sequentially changing from dark to light;

the configuration register further stores a change trend of brightness between two adjacent breathing cycles, and the brightness change trend between the two adjacent breathing cycles comprises at least one of the following changes:

sequentially changing from dark to light, and then sequentially changing from light to dark;

sequentially changing from light to dark, and then sequentially changing from dark to light;

sequentially changing from light to dark, and then sequentially changing from light to dark;

sequentially changing from dark to light and then sequentially changing from dark to light.

18. An electronic device, used for adjusting brightness of a breathing light, comprising:

a processor; and a non-transitory memory having processor-executable instructions stored thereon that, when executed on the processor, cause the electronic device to:

determine a relation curve representing relationship between visual brightness and an electrical signal of a breathing light;

determine an electrical signal value corresponding to each brightness level of a plurality of brightness levels, wherein the plurality of brightness levels are obtained by equally dividing a visual brightness interval according to a brightness level limit;

determine a ratio between the electrical signal value corresponding to each brightness level and a maximum electrical signal value; and adjust, according to the ratio between the electrical signal value corresponding to each brightness level and the maximum electrical signal value, a magnitude of the electrical signal value inputted into the breathing light;

determine a first hold time of each brightness level according to a breathing cycle of the breathing light.

* * * * *